US007963520B2

(12) United States Patent
Tanaka et al.

(10) Patent No.: US 7,963,520 B2
(45) Date of Patent: Jun. 21, 2011

(54) SHEET LOADING DEVICE, SHEET CONVEYING DEVICE, AND IMAGE FORMING APPARATUS

(75) Inventors: Mizuna Tanaka, Osaka (JP); Hiroshi Fujiwara, Osaka (JP); Shigeo Nanno, Kyoto (JP); Tomoyoshi Yamazaki, Ibaraki (JP); Yasuhide Ohkubo, Osaka (JP); Haruyuki Honda, Ibaraki (JP); Ippei Kimura, Osaka (JP); Masafumi Takahira, Ibaraki (JP); Toshikane Nishii, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 489 days.

(21) Appl. No.: 12/010,347

(22) Filed: Jan. 24, 2008

(65) Prior Publication Data

US 2008/0237970 A1 Oct. 2, 2008

(30) Foreign Application Priority Data

Jan. 31, 2007 (JP) ..... 2007-022090
Oct. 9, 2007 (JP) ..... 2007-262874

(51) Int. Cl.
*B65H 3/52* (2006.01)

(52) U.S. Cl. ..... 271/121; 271/167

(58) Field of Classification Search ..... 271/121, 271/167
See application file for complete search history.

(56) References Cited

U.S. PATENT DOCUMENTS

| | | | | |
|---|---|---|---|---|
| 4,611,802 | A * | 9/1986 | Pedersen | 271/274 |
| 5,405,128 | A | 4/1995 | Fujiwara et al. | |
| 6,135,443 | A * | 10/2000 | Yano | 271/121 |
| 2003/0006546 | A1 * | 1/2003 | Toda et al. | 271/162 |
| 2004/0041334 | A1 * | 3/2004 | Yoshihara | 271/145 |
| 2007/0065201 | A1 | 3/2007 | Fujiwara et al. | |
| 2008/0093792 | A1 * | 4/2008 | Lee et al. | 271/126 |

FOREIGN PATENT DOCUMENTS

| | | |
|---|---|---|
| JP | SHO63-139240 | 9/1988 |
| JP | 2862768 | 12/1998 |
| JP | 2005-170520 | 6/2005 |
| JP | 2005-193526 | 7/2005 |

* cited by examiner

*Primary Examiner* — Michael C McCullough
(74) *Attorney, Agent, or Firm* — Harness, Dickey & Pierce, P.L.C.

(57) ABSTRACT

A sheet cassette loads and houses therein a plurality of sheets. A separating unit separates the sheets loaded in the sheet cassette one by one. The separating unit is arranged in the sheet cassette in opposite to a feeding roller that conveys the sheets from the sheet cassette. A rib is formed on a rear surface of a bottom plate of the sheet cassette. The rib is pressed by a pressing member.

19 Claims, 4 Drawing Sheets

SHEET LOADING DEVICE, SHEET CONVEYING DEVICE, AND IMAGE FORMING APPARATUS

CROSS-REFERENCE TO RELATED APPLICATIONS

The present application claims priority to and incorporates by reference the entire contents of Japanese priority documents 2007-022090 filed in Japan on Jan. 31, 2007 and 2007-262874 filed in Japan on Oct. 9, 2007.

BACKGROUND OF THE INVENTION

1. Field of the Invention

The present invention relates to a sheet loading device, and a sheet conveying device that includes the sheet loading device, and an image forming apparatus.

2. Description of the Related Art

In an image forming apparatus such as a copier, a printer, a facsimile, or a multifunction product (MFP) of the copier, the printer, and the facsimile, generally a sheet, which is housed in a sheet cassette, is transmitted by a sheet feeder to a transport path side, an image forming unit forms an image on the sheet that is transported via the transport path, and the sheet is transmitted to a sheet ejection tray.

The sheet feeder includes a feeding roller that transmits the sheet. The feeding roller and a separating pad, which is arranged opposite the feeding roller, separate each single sheet and transmit the sheet.

In a sheet feeding structure mentioned earlier, during transmission of the sheet, the sheet causes a stickslip on the separating pad. The stickslip indicates a precise operation in which the sheet on the separating pad is repeatedly stopped and transported for a moment. Minute oscillations, which occur due to the stickslip, are transmitted to a sheet cassette and peripheral members of the sheet cassette, thus causing abnormal noise. Due to this, environmental amenity worsens.

Following technologies are suggested as means to overcome the drawback mentioned earlier. In a technology disclosed in Japanese Patent Application Laid-open No. 2005-193526, a spindle is attached to a holder of the feeding roller such that the spindle minutely oscillates. The spindle is caused to oscillate at a phase that differs from a phase of the feeding roller, thus reducing the oscillations of the feeding roller. Further, in another technology disclosed in Japanese Patent Application Laid-open No. 2005-170520, an oscillation absorbing material formed of rubber is arranged between a sheet loading plate and a spring that presses the sheet loading plate in an upward direction.

However, in the technology disclosed in Japanese Patent Application Laid-open No. 2005-193526, presence of the spindle affects a mutual suppress strength between the feeding roller and the separating pad. Due to this, the feeding roller and the separating pad are not able to exhibit a stable sheet feeding ability. Further, even in the technology disclosed in Japanese Patent Application Laid-open No. 2005-170520, inclusion of the oscillation absorbing material affects the mutual suppress strength between the sheet loading plate and the feeding roller, thus hampering a stable sheet feeding.

SUMMARY OF THE INVENTION

It is an object of the present invention to at least partially solve the problems in the conventional technology According to an aspect of the present invention, there is provided a sheet loading device including a sheet cassette that loads and houses therein a plurality of sheets; a separating unit that separates the sheets loaded in the sheet cassette one by one, which is arranged in the sheet cassette in opposite to a feeding roller that conveys the sheets from the sheet cassette; and a rib that is formed on a rear surface of a bottom plate of the sheet cassette. The rib is pressed by a pressing member.

Furthermore, according to another aspect of the present invention, there is provided a sheet conveying device including a sheet loading device that includes a sheet cassette that loads and houses therein a plurality of sheets, a separating unit that separates the sheets loaded in the sheet cassette one by one, and a rib that is formed on a rear surface of a bottom plate of the sheet cassette, which is pressed by a pressing member; and a feeding roller that conveys the sheets from the sheet cassette, the feeding roller being arranged in opposite to the separating unit.

Moreover, according to still another aspect of the present invention, there is provided an image forming apparatus including a sheet conveying device that includes a sheet loading device including a sheet cassette that loads and houses therein a plurality of sheets, a separating unit that separates the sheets loaded in the sheet cassette one by one, and a rib that is formed on a rear surface of a bottom plate of the sheet cassette, which is pressed by a pressing member, and a feeding roller that conveys the sheets from the sheet cassette, the feeding roller being arranged in opposite to the separating unit; and an imaging unit that forms an image on a sheet that is conveyed from the sheet conveying device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings.

Figure 1:
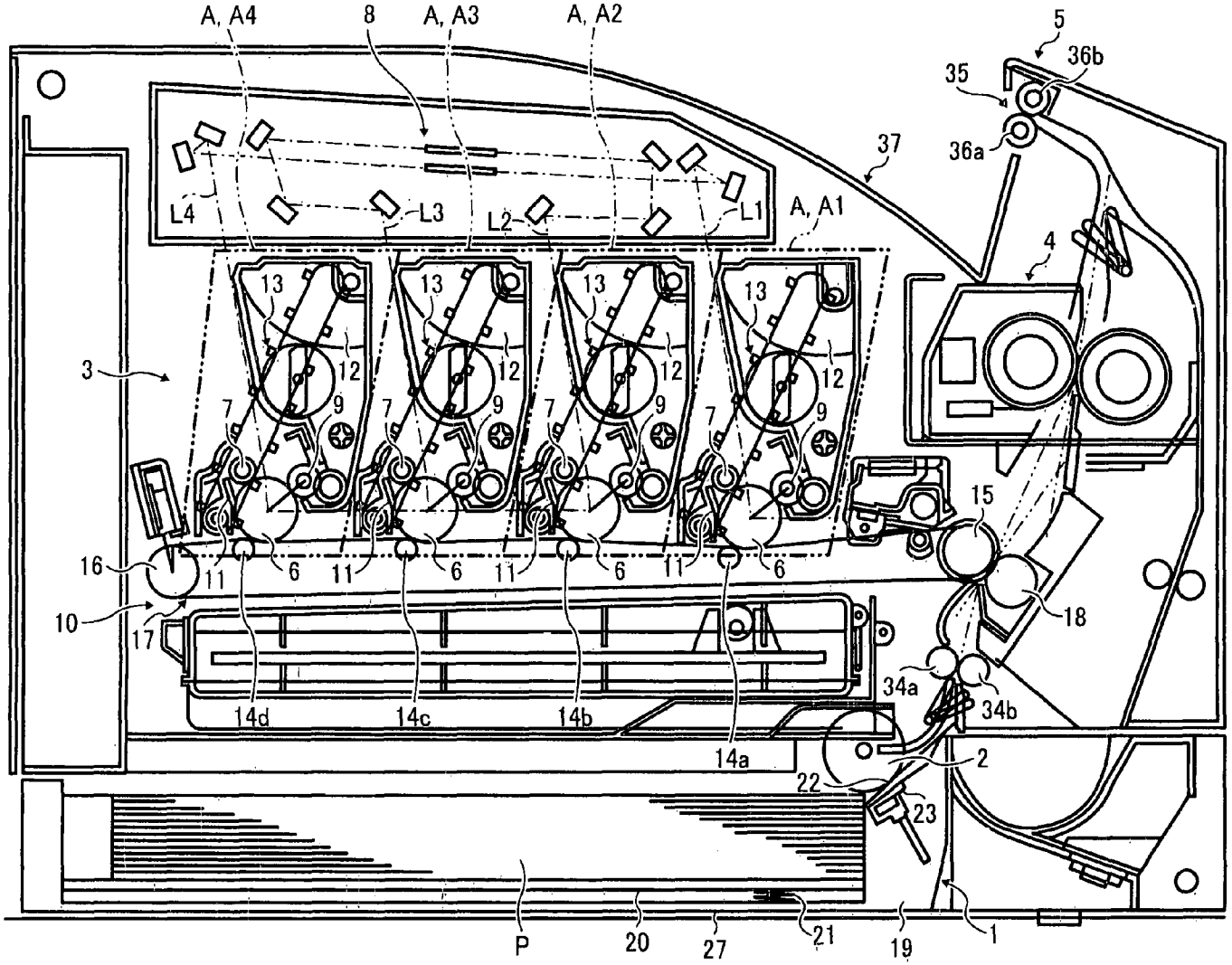
FIG. 1 is a schematic diagram of an overview of an image forming apparatus according to an embodiment of the present invention.

FIG. 1 is a schematic diagram of an overview of a color image forming apparatus. Main components of the image forming apparatus are explained below with reference to FIG. 1. The image forming apparatus includes a sheet loading device 1, a feeding roller 2, an imaging unit 3, a fixing device 4, and an ejecting unit 5. A printing sheet P, which is a sheet for image formation, (hereinafter, "sheet") is loaded on the sheet loading device 1. The feeding roller 2 transmits the sheet P from the sheet loading device 1. The imaging unit 3 forms an image on the sheet P that is transmitted by the feeding roller 2. The fixing device 4 fixes by heating, the image that is formed on the sheet P by the imaging unit 3. The ejecting unit 5 ejects the sheet P to outside.

The imaging unit 3 forms the image by using toners, as developing materials, of yellow, magenta, cyan, and black colors that correspond to color components of a color image. The imaging unit 3 includes as main components, image bearing members 6 (photosensitive drums), chargers 7, an exposing unit 8, developers 9, and a transfer device 10. The chargers 7 charge a surface of the image bearing members 6. The exposing unit 8 exposes the surface of the image bearing members 6. The developers 9 form toner images on the surface of the image bearing members 6. The transfer device 10 transfers the toner images onto the sheet P.

The image forming apparatus includes four process cartridges A (a first process cartridge A1 to a fourth process cartridge A4) that correspond to each color of the color image. The process cartridges A integrally include as image forming units, the respective image bearing members 6, the respective chargers 7, and the respective developers 9. Each process cartridge A is detachably attached to the main body of the image forming apparatus. Further, each process cartridge A internally includes a cleaning blade 11 and a toner transporting unit 13. The cleaning blade 11 removes toner that remains on the surface of the respective image bearing member 6. The toner transporting unit 13 transports the removed waste toner to a collector 12 inside the respective process cartridge A.

The transfer device 10 includes four primary transferring rollers 14*a* to 14*d*, an intermediate transfer belt 17, and a secondary transferring roller 18. The primary transferring rollers 14*a* to 14*d* are arranged opposite the respective image bearing members 6. The intermediate transfer belt 17, which is stretched on a driving roller 15 and a driven roller 16, rotatably runs. The secondary transferring roller 18 is arranged opposite the driving roller 15.

A sheet cassette 19 is included as the sheet loading device 1 in a lower portion of the image forming apparatus. The sheet cassette 19 includes a loading plate 20 on which a large number of the sheets P are loaded. A spring 21 is arranged between a bottom plate 27 of the sheet cassette 19 and the loading plate 20. Due to the spring 21, the loading plate 20 is always biased in the upward direction and the sheets P for loading touch the feeding roller 2.

A separating unit 22 is arranged opposite the feeding roller 2 in the sheet cassette 19. The separating unit 22 separates each single sheet P. The separating unit 22 is a rectangular shaped friction pad formed of a material having a high friction coefficient. The separating unit 22 is arranged on an upper surface of a pad base 23. A not shown pressurizing spring is arranged on a lower surface side of the pad base 23. The pressurizing spring presses the pad base 23 in the upward direction, thereby pressing the separating unit 22 against the feeding roller 2.

Figure 2:
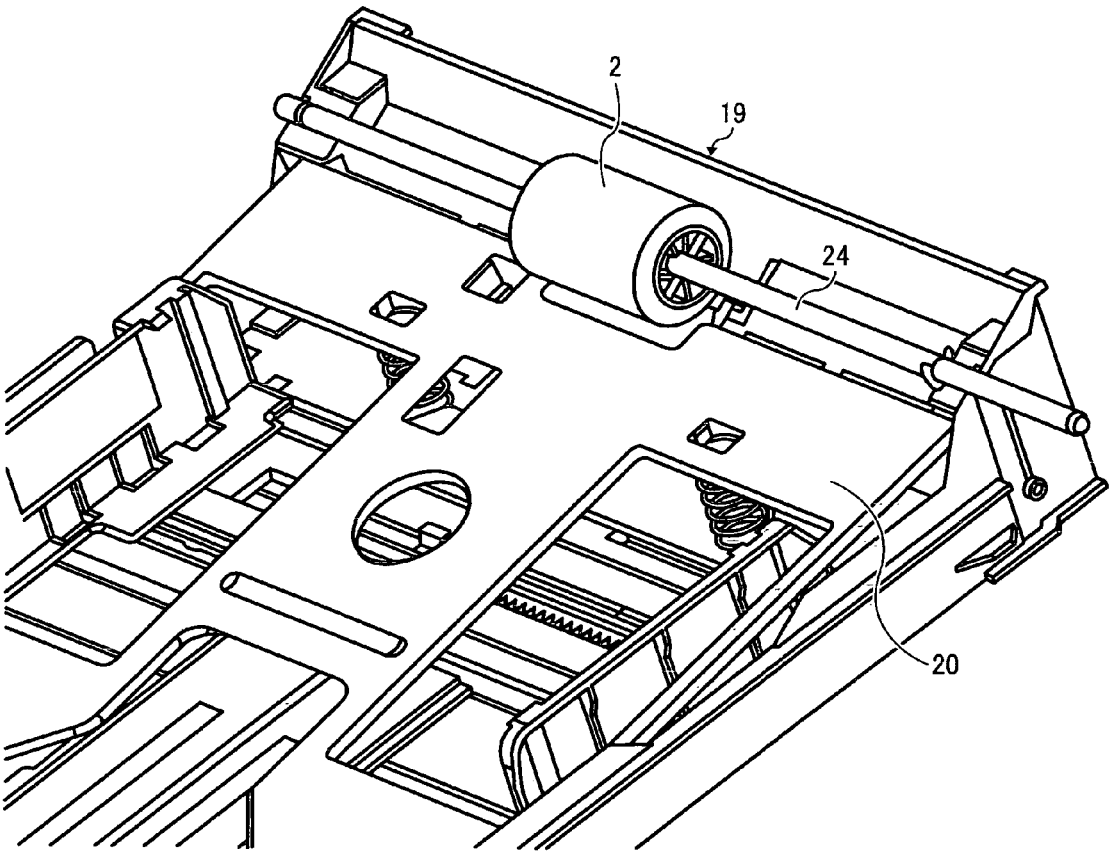
FIG. 2 is a schematic diagram of a sheet cassette that is arranged in the image forming apparatus shown in FIG. 1.

FIG. 2 is a schematic diagram of the feeding roller 2 and the sheet cassette 19. As shown in FIG. 2, a supporting shaft 24, which extends in a sheet width direction (a transport width direction) of the feeding roller 2, is integrally arranged in the feeding roller 2. Both the ends of the supporting shaft 24 are rotatably fixed to the main body of the image forming apparatus.

Figure 3:
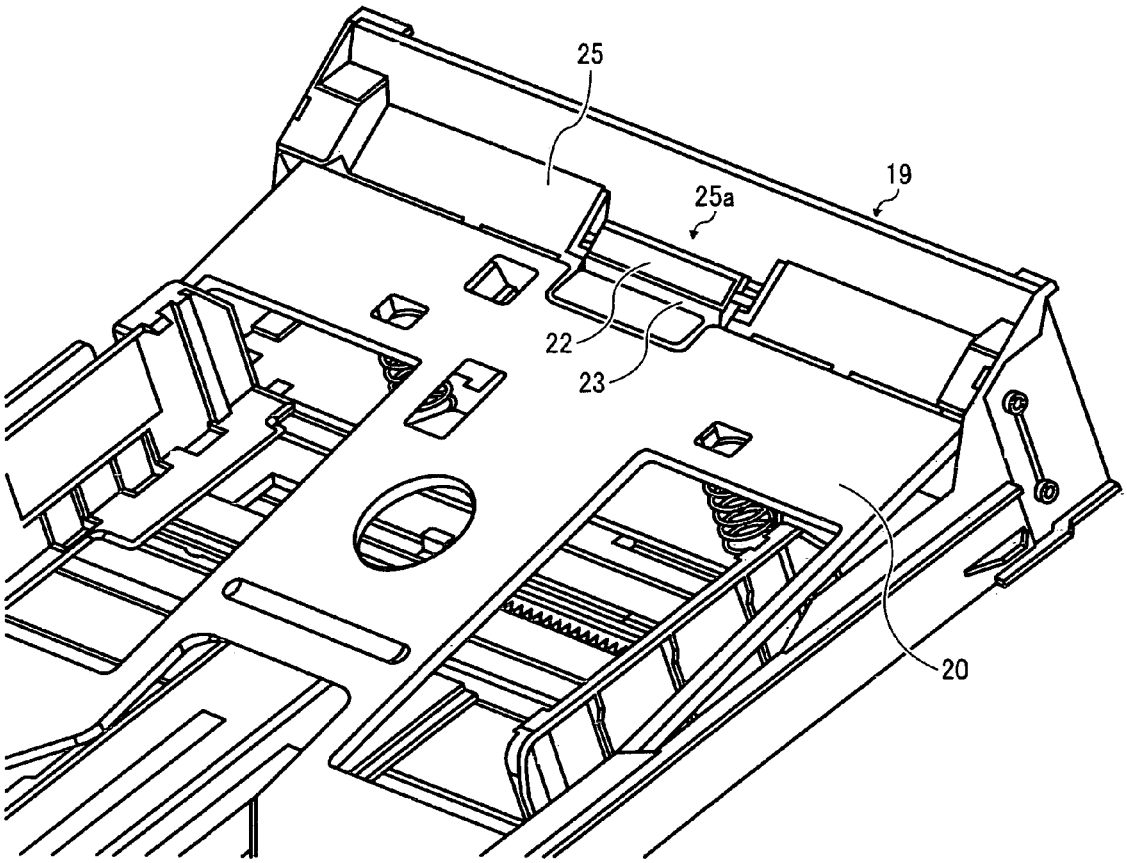
FIG. 3 is another schematic diagram of the sheet cassette.

FIG. 3 is a schematic diagram of the sheet cassette 19 without the feeding roller 2 that is shown in FIG. 2. As shown in FIG. 3, a guiding plate 25, which guides the sheet P, is arranged in a downstream side of a transport direction compared to the loading plate 20. The pad base 23 is arranged such that the pad base 23 protrudes in the upward direction from an opening 25*a* that is formed midway in the transport width direction of the guiding plate 25.

Figure 4:
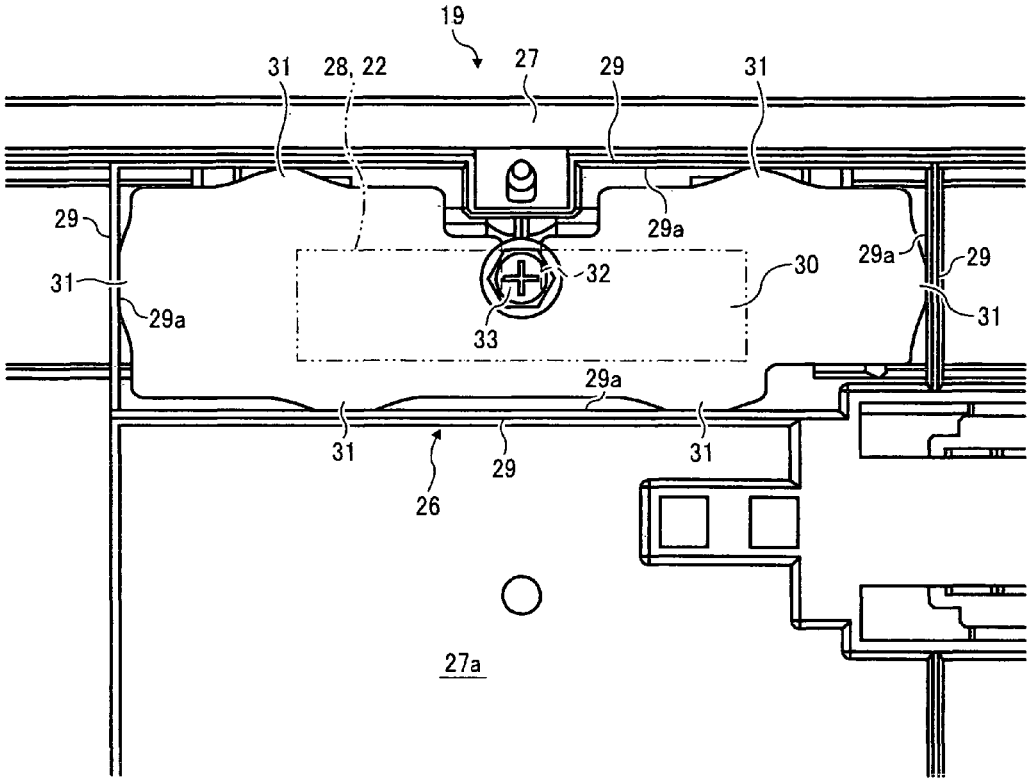
FIG. 4 is a schematic diagram of main components of the sheet cassette viewed from a rear surface.

FIG. 4 is a schematic diagram of the sheet cassette 19 viewed from a backside of the bottom plate 27. The upper direction shown in FIG. 4 is the downstream side of the transport direction. A thin plate shaped rib 26 is vertically arranged on a rear surface 27*a* of the bottom plate 27. Further, as shown in FIG. 4, a two-dot chain line indicates a portion 28 in the rear surface 27*a* that corresponds to the lower side of the separating unit 22. A portion of the rib 26 is arranged such that the rib 26 encloses outer side of the corresponding portion 28. To be specific, the rib 26, which encloses the corresponding portion 28, includes four nearly linear thin sections 29 that are arranged on the upstream side, the downstream side, left, and right of the corresponding portion 28. Ends of the four thin sections 29 are linked to each other.

A tabular pressing member 30 is pressure fitted inside a nearly rectangular rib frame that is formed of the four thin sections 29. The pressing member 30 is preferably formed of a material such as a steel plate having a higher rigidity and a greater specific gravity compared to the rib 26. A plurality of triangular shaped convex members 31 are arranged in a peripheral portion of the pressing member 30. Apexes of the convex members 31 directly touch vertical surfaces 29*a* on the inner side of the thin portions 29 that are orthogonally arranged with respect to the rear surface 27*a*. Further, the apexes of the convex members 31 are pressed against the vertical surfaces 29*a* from the inner side towards the outer side in an orthogonal direction. The pressing member 30 touches and presses the short thin sections 29 on the left and the right at one portion respectively. Further, the pressing member 30 touches and presses the long thin sections 29 on the upstream side and the downstream side at two portions respectively. For imparting a high suppress strength to the thin sections 29, desirably, the convex members 31 need to linearly touch the thin sections 29 in a depth direction (vertical direction of the main body of the image forming apparatus) shown in FIG. 4. Dimensions of the pressing member 30 are regulated such that the pressing member 30 penetrates the vertical surfaces 29*a*, thus causing the apexes of the convex members 31 to press against the vertical surfaces 29*a* from the inner side towards the outer side in the orthogonal direction. The pressing member 30 shown in FIG. 4 has penetrated the vertical surfaces 29*a* on the upstream side, on the downstream side, to the left, and to the right.

The pressing member 30 is fixed to the bottom plate 27 of the sheet cassette 19 by a setscrew 33. To be specific, a penetration bracket 32 is formed in the vicinity of the center of the pressing member 30 for inserting the setscrew 33. A not shown internal thread bracket is arranged on the rear surface 27*a* of the bottom plate 27 for screwing the setscrew 33.

As shown in FIG. 1, a pair of resist rollers 34*a* and 34*b*, which stop the sheet P, is arranged at a marginally downstream side of the feeding roller 2. A pair of sheet ejecting rollers 36*a* and 36*b* is arranged, as the ejecting unit 5 that ejects the sheet P, at a sheet ejection opening 35 that is formed in the upper portion of the main body of the image forming apparatus. A sheet ejection tray 37, which causes a portion of an upper portion cover of the image forming apparatus to dent medially, is arranged on the lower side of the sheet ejection opening 35.

As shown in FIG. 1, the loading plate 20 that includes the loaded sheets P is biased in the upward direction by the spring 21 on the lower side and the uppermost sheet P is pressed against the feeding roller 2. Further, the separating unit 22 is pressed against the side of the feeding roller 2 at a predetermined pressure by an elastic bias force of the not shown pressurizing spring.

When the feeding roller 2 rotates due to sheet feeding signals from a not shown controller of the image forming apparatus, only the uppermost sheet P is separated and transmitted to the resist rollers 34*a* and 34*b* on the downstream side. Upon a tip of the sheet P reaching a nip between the resist rollers 34*a* and 34*b*, for securing a timing that is synchronous with the toner images that are formed by the imaging unit 3, the resist rollers 34*a* and 34*b* await while forming a slack in the sheet P.

An image forming operation is explained next. First, the chargers 7 charge the surface of the image bearing members 6 to a uniformly high electric potential. Next, based on image data, the exposing unit 8 emits laser beams (L1 to L4) on the surface of the image bearing members 6, thereby reducing the electric potential of surface portions exposed to the laser beams and forming electrostatic latent images on the surface of the respective image bearing members 6. The developers 9 transfer toner to the surface portions of the respective image bearing members 6 where the electrostatic latent images are formed, thus forming (developing) the toner images of the respective color. The toner images of the respective color on the image bearing members 6 are transferred to the intermediate transfer belt 17 such that the toner images overlap.

The resist rollers 34*a*, 34*b* and the feeding roller 2 resume driving to secure a timing that is synchronous with the toner images that are overlapped and transferred on the intermediate transfer belt 17 and transmit the sheet P to the secondary transferring roller 18. The secondary transferring roller 18 transfers the overlapped and transferred toner images on the transmitted sheet P. Next, the sheet P, which includes the transferred toner images, is transported to the fixing device 4. The toner images on the sheet P are fixed by heating. Next, the sheet P is ejected to the sheet ejection tray 37 from the sheet ejection opening 35 that is arranged in the upper portion of the main body of the image forming apparatus.

After completion of image transfer, the cleaning blade 11 scrapes the toner that remains on the surface of the respective image bearing members 6. The toner transporting unit 13 transmits the scraped waste toner to the collector 12 and stores the waste toner in the collector 12.

When transmitting the sheet P, the feeding roller 2 causes a stickslip on the separating unit 22. Minute oscillations, which are generated due to the stickslip on the separating unit 22, are transmitted to the periphery of the separating unit 22 and to the rib 26 that is on the rear surface 27*a* of the sheet cassette 19. Upon being transmitted to the rib 26, the oscillations are amplified by the rib 26. The amplified oscillations cause the entire sheet-feeding tray to shake, thus resulting in occurrence of noise due to oscillation noise. Although the thin plate shaped rib 26 having a low rigidity is prone to oscillation, because the rib 26 is pressed by the pressing member 30, the oscillations of the rib 26 are curbed. In other words, as shown in FIG. 4, although the rib 26 is prone to oscillation in the orthogonal direction with respect to the vertical surfaces 29*a*, the pressing member 30 presses the rib 26 with respect to the vertical surfaces 29*a* in the orthogonal direction, thereby imparting a pulling force or a compressing force to the rib 26. Due to this, even if the oscillations due to the stickslip are transmitted to the rib 26, further deformation of the rib 26 in a direction prone to oscillation is curbed. Thus, curbing the oscillations of the rib 26 also reduces the oscillations of the entire sheet cassette 19.

Further, the pressing member 30 that is formed with the heavy steel plate functions as a spindle that changes a intrinsic oscillation frequency of the sheet cassette 19. In other words, the pressing member 30 delays the intrinsic oscillation frequency of the sheet cassette 19 with respect to an oscillation frequency of the separating unit 22 that is an oscillation source, thereby preventing a resonance phenomenon.

Figure 5:
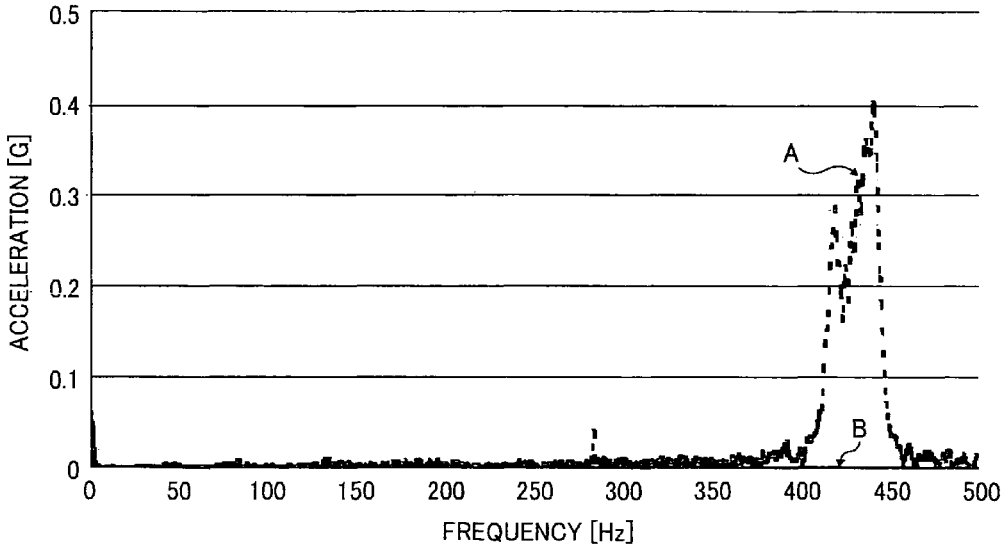
FIG. 5 is a graph of oscillations generated in the sheet cassette in a case where a rib is pressed by a pressing member and in a case where the rib is not pressed by the pressing member, obtained by a frequency analysis using FFT.

FIG. 5 is a graph of the oscillations, which occur in the sheet cassette 19 when the rib 26 is pressed by the pressing member 30 and when the rib 26 is not pressed by the pressing member 30, and that are indicated by a frequency analysis using fast fourier transform (FFT). As shown in FIG. 5, a dotted line (A) indicates the oscillations when the rib 26 is not pressed by the pressing member 30. The oscillations having a frequency of 440 Hz and a maximum oscillation of 0.4 G occur when the rib 26 is not pressed by the pressing member 30. A line (B) which overlaps with a horizontal axis of the graph indicates the oscillations when the rib 26 is pressed by the pressing member 30. When the rib 26 is pressed by the pressing member 30, the oscillations are negligible. Thus, the oscillations are reduced compared to the oscillations that are indicated by the dotted line (A).

The embodiment of the present invention is explained. However, the present invention is not limited to the representative embodiment shown and described herein, and various modifications may be made without departing from the spirit or scope of the general inventive concept as defined by the appended claims and their equivalents. A shape and a position of the rib 26, which is formed on the rear surface of the sheet cassette 19, need not be the same as the shape and the position that are indicated in the embodiment shown in FIG. 4. For example, a pair of the thin sections 29 can be arranged opposite to each other. The thin sections 29 can be arranged in a triangular frame shape or in a polygonal frame shape of a pentagon or a higher polygon. The pressing member 30 can be pressure fitted mutually among the thin sections 29. Further, if the rib 26 is arranged inside the corresponding portion 28, the pressing member 30 can also press the rib 26. Further, the pressing member 30 can also press the frame shaped rib 26 from the outside towards the inside, and press the thin sections 29 at more than three portions. A structure according to the present invention can also be applied to an inkjet type image forming apparatus in which ink is discharged on a sheet shaped recording medium from an ink discharge opening of a print head to form an image. Similarly, the structure of the sheet loading device according to the present invention can also be widely applied to a device that transports sheets other than printing sheets, or to other devices.

When feeding a sheet, even if a stickslip occurs on a separating unit, because a rib is pressed by a pressing member, oscillations of the rib are curbed. In other words, pressing the rib using the pressing member and prior imparting a pulling force or a compressing force enables to curb a further deformation of the rib in an oscillation direction even if minute oscillations due to the stickslip are transmitted to the rib that is prone to oscillations. Thus, the oscillations of the entire sheet cassette can be reduced.

As described above, according to an aspect of the present invention, when transporting a sheet, oscillations of a rib are curbed by a pressing member even if a stickslip occurs on a separating unit. Due to this, the oscillations of an entire sheet cassette can be reduced. Thus, occurrence of noise due to the oscillations of the sheet cassette can be prevented. Furthermore, because the pressing member does not affect a sheet feeding performance, a stable sheet transmission can be maintained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet loading device, comprising:

a sheet cassette that loads and houses therein a plurality of sheets;

a separating unit that separates the sheets loaded in the sheet cassette one by one, the separating unit being arranged in the sheet cassette opposite to a feeding roller that conveys the sheets from the sheet cassette; and a rib that is formed on a rear surface of a bottom plate of the sheet cassette, wherein the rib is pressed by a pressing member such that the pressing member presses the rib in a direction crossing or lateral to a direction in which the rib protrudes.

2. The sheet loading device according to claim 1, wherein the rib is formed in a vicinity of a portion, in the rear surface of the bottom plate, corresponding to a lower side of the separating unit, and is pressed by the pressing member.

3. The sheet loading device according to claim 2, wherein the rib is arranged on the rear surface of the bottom plate to enclose the corresponding lower side of the separating unit.

4. The sheet loading device according to claim 3, wherein the rib includes four nearly linear thin sections that are arranged on an upstream side, a downstream side, left, and right of the corresponding lower side of the separating unit.

5. The sheet loading device according to claim 4, wherein ends of the four thin sections are linked to each other.

6. The sheet loading device according to claim 1, wherein the pressing member directly contacts and presses the rib.

7. The sheet loading device according to claim 1, wherein the pressing member contacts and presses the rib in a substantially linear manner.

8. The sheet loading device according to claim 1, wherein the rib is formed by a plurality of thin sections formed in nearly line-shape that are at least one of mutually separated and differently directed, and each of the plurality of thin sections is pressed by the pressing member.

9. The sheet loading device according to claim 8, wherein the plurality of thin sections are formed in such a manner that the plurality of thin sections enclose a portion, in the rear surface of the bottom plate, corresponding to a lower side of the separating unit, and the plurality of thin sections are pressed by the pressing member.

10. The sheet loading device according to claim 8, wherein the pressing member is pressure fitted between the plurality of thin sections.

11. The sheet loading device according to claim 8, wherein the pressing member presses the plurality of thin sections at a plurality of portions.

12. The sheet loading device according to claim 1, wherein the pressing member is formed of a material of higher rigidity compared to the rib.

13. The sheet loading device according to claim 1, wherein the pressing member is formed of a material of a greater specific gravity compared to the rib.

14. The sheet loading device according to claim 1, wherein the pressing member is formed of a steel plate and a peripheral portion of the pressing member contacts the rib in a substantially linear manner.

15. The sheet loading device according to claim 1, wherein the rib is vertically formed on the rear surface of the bottom plate of the sheet cassette.

16. The sheet loading device according to claim 1, wherein the pressing member is fixed to the bottom plate by a setscrew.

17. The sheet loading device according to claim 16, wherein a penetration bracket is formed in a vicinity of a center of the pressing member for inserting the setscrew.

18. A sheet conveying device, comprising:

a sheet loading device including a sheet cassette that loads and houses therein a plurality of sheets, a separating unit that separates the sheets loaded in the sheet cassette one by one, and a rib that is formed on a rear surface of a bottom plate of the sheet cassette, the rib being pressed by a pressing member such that the pressing member presses the rib in a direction crossing or lateral to a direction in which the rib protrudes; and a feeding roller that conveys the sheets from the sheet cassette, the feeding roller being arranged opposite to the separating unit.

19. An image forming apparatus, comprising:

a sheet conveying device including a sheet loading device that includes a sheet cassette that loads and houses therein a plurality of sheets, a separating unit that separates the sheets loaded in the sheet cassette one by one, and a rib that is formed on a rear surface of a bottom plate of the sheet cassette, the rib being pressed by a pressing member such that the pressing member presses the rib in a direction crossing or lateral to a direction in which the rib protrudes, and a feeding roller that conveys the sheets from the sheet cassette, the feeding roller being arranged opposite to the separating unit; and an imaging unit that forms an image on a sheet that is conveyed from the sheet conveying device.

* * * * *